US007131380B2

(12) United States Patent
Huffer

(10) Patent No.: US 7,131,380 B2
(45) **Date of Patent: *Nov. 7, 2006**

(54) EB PATTERN PROFILE PRINTING

(75) Inventor: Scott W. Huffer, Hartsville, SC (US)

(73) Assignee: Sonoco Development, Inc., Hartsville, SC (US)

( * ) Notice: Subject to any disclaimer, the term of this patent is extended or adjusted under 35 U.S.C. 154(b) by 328 days.

This patent is subject to a terminal disclaimer.

(21) Appl. No.: 10/037,271

(22) Filed: Nov. 7, 2001

(65) Prior Publication Data

US 2003/0087072 A1 May 8, 2003

(51) Int. Cl.
*B41F 31/00* (2006.01)
*B41F 33/00* (2006.01)

(52) U.S. Cl. ..... 101/491; 101/483; 427/258; 427/261; 427/265; 428/195; 428/207

(58) Field of Classification Search ..... 101/211, 101/483, 491, DIG. 29; 106/31.27, 31.6, 106/31.13; 427/256, 258, 261, 265, 287; 428/195, 204, 207, 209
See application file for complete search history.

(56) References Cited

U.S. PATENT DOCUMENTS

| | | | | |
|---|---|---|---|---|
| 1,509,664 | A | 9/1924 | Brown | |
| 2,793,585 | A | 5/1957 | Granitsas | 101/28 |
| 3,134,892 | A | 5/1964 | Opitz et al. | 219/69 |
| 3,504,059 | A | 3/1970 | Glen, Jr. | 264/1 |
| 3,647,959 | A | 3/1972 | Schlesinger et al. | 178/7.87 |
| 3,750,117 | A | 7/1973 | Chen et al. | 340/173 LS |
| 3,811,915 | A * | 5/1974 | Burrell et al. | 428/143 |
| 3,859,110 | A | 1/1975 | Foster et al. | 117/27 |
| 4,079,673 | A | 3/1978 | Bernstein | 101/426 |
| 4,124,947 | A | 11/1978 | Kuhl et al. | 40/453 |
| 4,169,907 | A | 10/1979 | Barker et al. | |
| 4,184,700 | A | 1/1980 | Greenaway | 283/6 |
| 4,233,343 | A | 11/1980 | Barker et al. | |
| 4,269,473 | A | 5/1981 | Flothmann et al. | 350/3.61 |
| 4,329,409 | A | 5/1982 | Wreede et al. | 430/1 |
| 4,330,604 | A | 5/1982 | Wreede et al. | 430/2 |
| 4,490,410 | A | 12/1984 | Takiyama et al. | 427/44 |
| 4,748,452 | A | 5/1988 | Maurer | 346/1.1 |
| 4,758,296 | A | 7/1988 | McGrew | 156/231 |
| 4,759,982 | A | 7/1988 | Jennssen | 428/343 |
| 4,842,633 | A | 6/1989 | Kuribayashi et al. | 65/44 |
| 4,856,857 | A | 8/1989 | Takeuchi et al. | 350/3.6 |
| 4,857,425 | A | 8/1989 | Phillips | 430/1 |
| 4,898,648 | A | 2/1990 | Cusano | 204/15 |
| 4,908,063 | A | 3/1990 | Baker et al. | 106/31 |
| 4,933,120 | A | 6/1990 | D'Amato et al. | 264/13 |
| 4,933,218 | A | 6/1990 | Longobardi | 428/38 |
| 4,970,129 | A | 11/1990 | Ingwall et al. | 430/1 |

(Continued)

FOREIGN PATENT DOCUMENTS

EP 0 569 640 A1 8/1992

(Continued)

*Primary Examiner*—Ren Yan
(74) *Attorney, Agent, or Firm*—DLA Piper

(57) ABSTRACT

The present invention provides a printing process and a printed product in which a coating is combined with an additive that lowers the surface tension of the dried coating. The coating pattern is printed on a substrate, and is cured using electron beam ("EB") processing. An ink is printed on top of the dried coating pattern. The ink flows away from the coating due to the difference in surface tension, forming a pattern of raised ink between the pattern and the coating.

12 Claims, 2 Drawing Sheets

U.S. PATENT DOCUMENTS

| | | | | | |
|---|---|---|---|---|---|
| 4,973,656 | A | | 11/1990 | Blount | 528/272 |
| 5,003,915 | A | | 4/1991 | D'Amato et al. | 118/46 |
| 5,005,872 | A | | 4/1991 | Lass et al. | 283/85 |
| 5,008,144 | A | | 4/1991 | Baker et al. | 428/211 |
| 5,013,494 | A | | 5/1991 | Kubo et al. | 264/1.3 |
| 5,019,202 | A | * | 5/1991 | Kawahata et al. | 156/277 |
| 5,058,992 | A | | 10/1991 | Takahashi | 359/567 |
| 5,085,514 | A | | 2/1992 | Mallik et al. | 359/2 |
| 5,106,126 | A | | 4/1992 | Longobardi et al. | 283/94 |
| 5,116,548 | A | | 5/1992 | Mallik et al. | 264/1.3 |
| 5,122,813 | A | | 6/1992 | Lass et al. | 346/1.1 |
| 5,304,411 | A | * | 4/1994 | Rusincovitch, Jr. | 428/141 |
| 5,330,799 | A | | 7/1994 | Sandor et al. | 427/510 |
| 5,401,303 | A | | 3/1995 | Stoffel et al. | 106/20 R |
| 5,505,320 | A | | 4/1996 | Burns et al. | 216/13 |
| 5,508,731 | A | | 4/1996 | Kohorn | 348/1 |
| 5,538,674 | A | | 7/1996 | Nisper et al. | 264/1.31 |
| 5,539,440 | A | | 7/1996 | Higuchi et al. | 347/112 |
| 5,554,432 | A | | 9/1996 | Sandor et al. | 428/157 |
| 5,633,735 | A | | 5/1997 | Hunter, Jr. et al. | 395/15 |
| 5,639,391 | A | | 6/1997 | Person | 219/121.68 |
| 5,654,782 | A | | 8/1997 | Morokawa et al. | 349/143 |
| 5,665,457 | A | * | 9/1997 | Sato et al. | 428/195.1 |
| 5,697,844 | A | | 12/1997 | Von Kohorn | 463/40 |
| 5,713,795 | A | | 2/1998 | Kohorn | 463/17 |
| 5,716,682 | A | | 2/1998 | Lovison et al. | 428/30 |
| 5,742,432 | A | | 4/1998 | Bianco | 359/566 |
| 5,759,101 | A | | 6/1998 | Von Kohorn | 463/40 |
| 5,838,468 | A | | 11/1998 | Manako et al. | 359/15 |
| 5,916,024 | A | | 6/1999 | Von Kohorn | 463/40 |
| 5,944,356 | A | | 8/1999 | Bergmann et al. | 283/86 |
| 5,968,607 | A | | 10/1999 | Lovison | 427/511 |
| 5,982,545 | A | | 11/1999 | Su | 359/569 |
| 6,008,774 | A | | 12/1999 | Wu | 343/828 |
| 6,043,936 | A | | 3/2000 | Large | 359/572 |
| 6,066,378 | A | | 5/2000 | Morii et al. | 428/40.2 |
| 6,087,940 | A | | 7/2000 | Caperna et al. | 340/572.5 |
| 6,146,032 | A | | 11/2000 | Dunham | 400/120.18 |
| 6,147,662 | A | | 11/2000 | Grabau et al. | 343/895 |
| 6,222,157 | B1 | | 4/2001 | Langille et al. | 219/121.69 |
| 6,546,872 | B1 | * | 4/2003 | Huffer et al. | 101/491 |
| 6,551,694 | B1 | * | 4/2003 | Imamichi et al. | 428/213 |

FOREIGN PATENT DOCUMENTS

| | | |
|---|---|---|
| EP | 1 022 151 A1 | 7/1999 |
| EP | 0 974 626 A1 | 1/2000 |
| GB | 2 259 874 A | 3/1993 |
| JP | 55-146785 | 11/1980 |
| WO | WO 00/37258 | 6/2000 |

* cited by examiner

EB PATTERN PROFILE PRINTING

FIELD OF THE INVENTION

The present invention relates to a method of printing and printed products. More specifically, the present invention relates to a method of printing profile ridges by applying resin to a low surface tension ink.

BACKGROUND OF THE APPLICATION

In today's marketplace, products are often distinguished as much by the packaging in which they are presented as the quality of the product itself. A package which catches the eye of the consumer is therefore very desirable. To that end, increasingly colorful and creative graphics have been applied to packaging in an attempt to distinguish one package, and hence one product, from another.

One popular graphic with visual appeal for consumers is the hologram. Holograms present a three dimensional image to the consumer. Unfortunately, holograms are expensive to produce, requiring high precision embossing equipment and tools. The capital expense required to produce holograms is high enough that holograms are often used as a security device. Simpler embossing methods can be used at lower cost than holograms to produce a graphic with a textured or raised look and feel. Embossing can produce interesting visual effects when a clear profile is embossed over an image. The underlying image appears differently from various viewing angles due to refraction of light through the embossed profile. However, even simple embossing equipment typically requires a significant capital expenditure.

SUMMARY OF THE INVENTION

The present invention provides a printing process and a printed product in which a coating is combined with an additive that lowers the surface tension of the dried coating. The printing process comprises the steps of providing a coating with a surface lowing additive, printing the coating onto a pubstrate in a pattern, curing the coating with electron beam ("EB") processing, printing ink over the coating, and allowing the ink to dry. The ink flows away from the clear resin due to the difference in surface tension, forming patterns of raised ink.

BRIEF DESCRIPTION OF THE DRAWINGS

For the purpose of illustrating the invention, there is shown in the drawings a form which is presently preferred; it being understood, however, that this invention is not limited to the precise arrangements and instrumentalities shown.

DETAILED DESCRIPTION OF THE DRAWINGS

Figure 1:
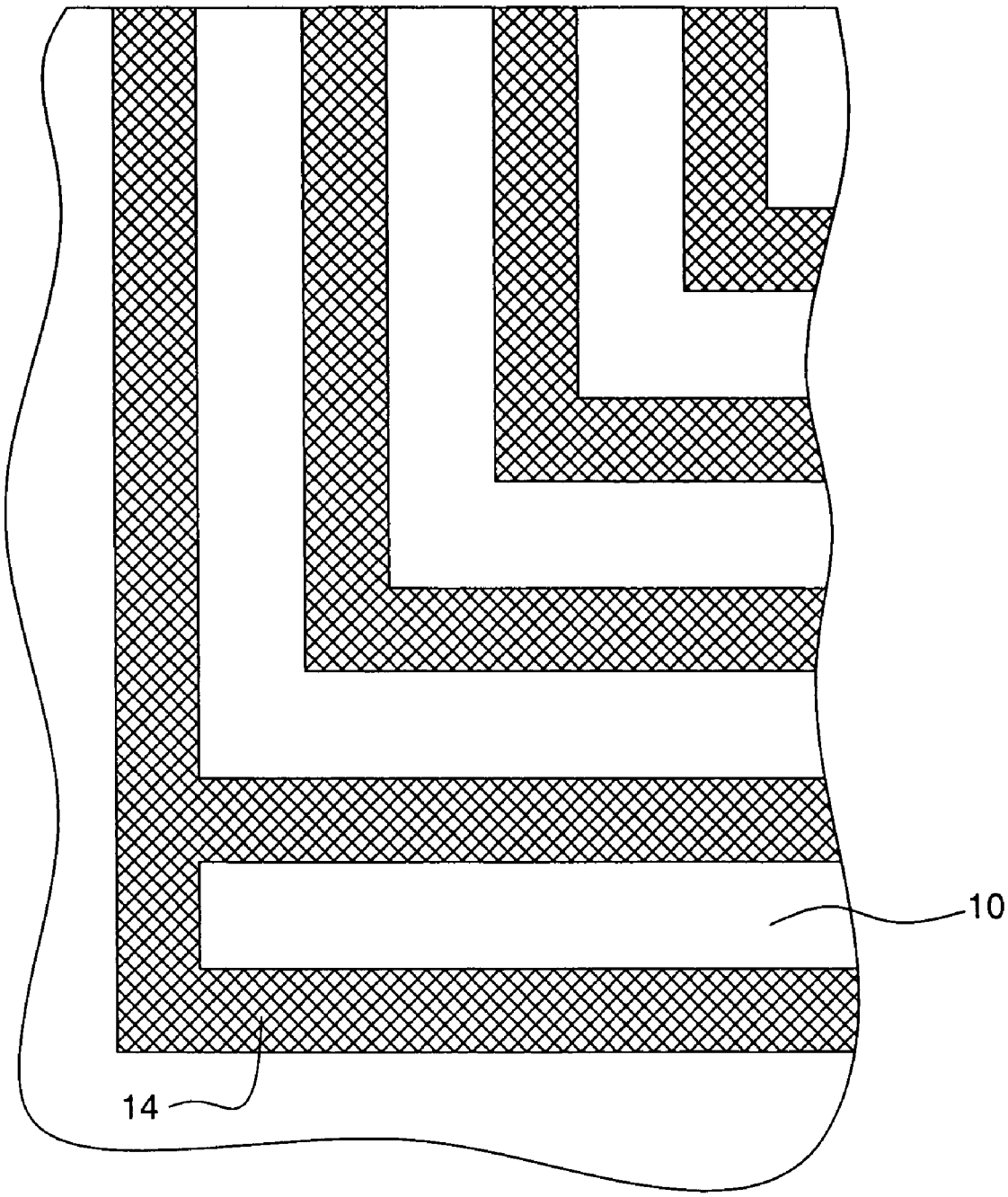
FIG. 1 is a top view of a portion of printed matter according to the present invention.
Figure 2:
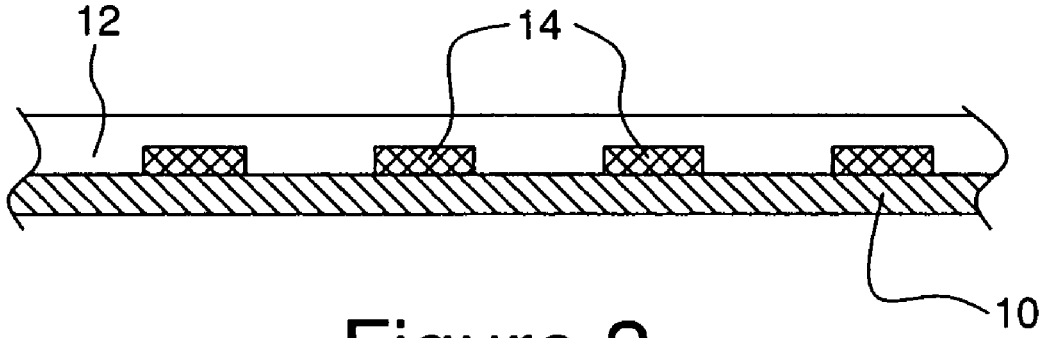
FIG. 2 is a cross section showing clear resin applied to a substrate and ink lines according to the present invention before any flow has occurred in the ink due to different surface tensions.
Figure 3:
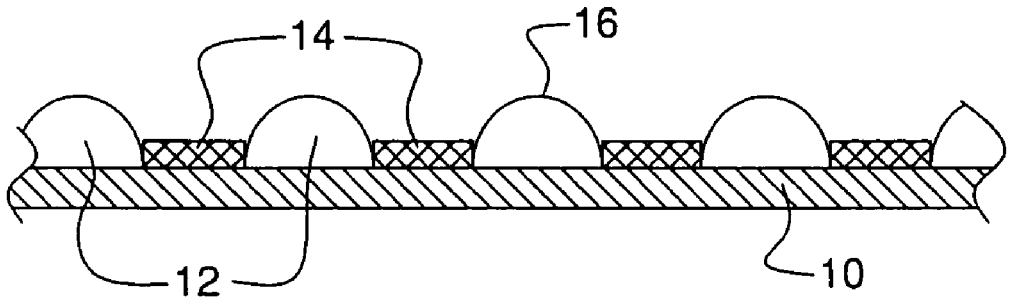
FIG. 3 is a cross section of printed matter according to the present invention.

In order to more clearly illustrate the invention, FIGS. 1–3 show a section of printed matter according to the present invention. FIGS. 1 and 3 show the printed matter following curing, and FIG. 2 shows the printed matter immediately prior to curing.

Before printing, the coating, which can be a resin or varnish, is combined with an additive that lowers the surface tension of the dried coating. One such additive is a hydroxy-modified polyether silane manufactured and sold by BYK-Chemie. The additive enhanced coating 14 is formed over the substrate 10 in a pattern of substantially parallel profile lines, leaving spaces between adjacent lines of coating 14 so that the substrate remains exposed. The substrate is preferably a non-printed metallized film, foil, or other reflective surface. The pattern is then electron beam cured. Electron beam curing produces higher ridges 16 (shown in FIG. 3) due to its 100% solids chemistry. EB curing also does not produce no volatile organic compounds (VOCs) or odors, as it is performed in a vacuum. Finally, EB processing allows for nearly instantaneous curing.

The electron beam curable coating is cured using a suitable electron beam source. Suitable electron beam sources may be obtained commercially from Energy Science, Inc. of Wilmington, Mass. The amount of energy absorbed, also known as the dose, is measured in units of MegaRads (MR or Mrad) or kiloGrays (kGy), where one Mrad is 10 kGy, one kGy being equal to 1,000 Joules per kilogram. The electron energy output should be within the range of 110 keV to 170 keV at a dosage of 2.5 to 5.0 MegaRads. Preferably, the energy is within the range of 125 keV to 135 keV at a dosage of 3.0 to 4.0 MegaRads.

When exposed to an electron beam from a suitable source, an acrylate monomer reacts with the epoxy acrylate chains to form crosslinks. The precursor molecules are excited directly by the ionizing electron beam. Therefore no initiator compounds are required, so no residual volatile organic compounds are present in the finished product. Moreover, curing is substantially instantaneous and provides a cure percentage at or near one hundred percent.

FIG. 1 shows a section of substrate 10 which has been overprinted with coating 14 in a profile pattern. The particular printing method used to apply the coating to the substrate is not important, and those of ordinary skill in the art will recognize that a variety of printing methods are available. One example of a suitable printing method is the rotogravure process. Rotogravure is preferable because it produces highly accurate images, while allowing for high press and production speeds. Rotogravure cylinders engraved by a laser will yield both the production volume and continuous channels necessary to produce the desired visual effect.

The laser engraver is capable of engraving deep continuous channels for the ink 12, as well. Mechanical engraving with a diamond stylus will only produce large cells with narrow channels of a much smaller volume.

An ink 12 is applied over the printed coating pattern area 14. The coating is preferably clear when dried. FIG. 2 shows a cross section of some printed matter immediately after the ink 12 has been applied. The ink 12 is in contact with both the printed dried coating 14 and the substrate 10 between lines of coating 14. Because the surface tension of the coating 14 is lower than the surface tension of the substrate 10, the ink 12 flows away from the coating 14 and toward the areas of exposed substrate 10.

FIG. 3 shows a cross section of printed matter according to the invention after the ink has completed its flow. The ink 12 has collected in the areas of exposed substrate 10 between the profile lines of coating 14. Thus, the ink 12 forms raised ridges 16 that are oriented along the patterned lines of coating 14. Because the coating is usually clear or translucent, refraction of light through the resin will cause the printed matter to change appearance when viewed from different angles. The coating 14 is allowed to set to form lasting raised profile ridges 16 oriented along the lines of the ink 12.

Without the additive in the coating, the ink would normally flow out to a continuous film and would not yield a refraction pattern as contemplated by the raised ridges in the present invention. Other visual effects can be created by the use of various colored or metallic inks that may be substituted for the clear profile resin.

It should be understood that when producing the printed structure on press, independent registration control is possible for the individual profile stations, resulting in better overall registration. Further, by the use of a laser engraver, highly accurate patterns can be created. Also, more volume of the resin or coating can be deposited on the surface due to the large volume of cells produced on the laser engraver. This large volume is possible with the present invention substantially without the occurrence of "flow outs". A later applied viscous coating would also discourage such "flow outs."

It is contemplated that further variations of the present invention are possible by the use of four color printing techniques and by the addition of scuff resistant protective coatings or the like.

The present invention may be embodied in still further specific forms without departing from the spirit or essential attributes thereof and, accordingly, reference should be made to the appended claims, rather than to the foregoing specification, as indicating the scope of the invention.

What is claimed is:

1. A printing process comprising the steps of:

a) providing a clear or translucent coating;

b) adding a surface tension lowering additive to the coating;

c) printing the coating onto a substrate in a pattern;

d) curing the coating by electron beam processing;

e) applying an ink over the substrate and the printed coating;

f) allowing the ink to flow from the coating pattern areas to the non- pattern areas; and g) allowing the ink to dry in the form of raised profile ridges.

2. The printing process of claim 1 wherein the coating is printed in a pattern of substantially parallel lines.

3. The printing process of claim 2 wherein the coating pattern is printed such that non-printed areas remain between the substantially parallel lines of printed coating.

4. The printing process of claim 2 wherein the ink forms raised ridges oriented along the printed coating pattern.

5. The printing process of claim 1 wherein the coating is a resin.

6. The printing process of claim 5 wherein the resin coating is clear.

7. The printing process of claim 1 wherein the coating is a varnish.

8. The printing process of claim 1 wherein the substrate is a reflective surface.

9. The printing process of claim 8 wherein the reflective surface is a metallized film.

10. The printing process of claim 8 wherein the reflective surface is a foil.

11. The printing process of claim 1 wherein the substrate is a clear film.

12. A printing process as claimed in claim 1 wherein the additive is hydroxy-modified polyether silane.

* * * * *